US008276560B2

(12) United States Patent
Hasebe et al.

(10) Patent No.: US 8,276,560 B2
(45) Date of Patent: Oct. 2, 2012

(54) V-TYPE ENGINE

(75) Inventors: Hiroaki Hasebe, Saitama (JP); Keita Ito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 785 days.

(21) Appl. No.: 11/960,049

(22) Filed: Dec. 19, 2007

(65) Prior Publication Data

US 2008/0156283 A1 Jul. 3, 2008

(30) Foreign Application Priority Data

Dec. 22, 2006 (JP) ..... 2006-346625

(51) Int. Cl.
*F02M 35/10* (2006.01)
*F02B 75/22* (2006.01)

(52) U.S. Cl. ..... 123/184.32; 123/54.4; 123/90.1

(58) Field of Classification Search ..... 123/184.21, 123/184.23, 184.31, 184.32, 51 BB, 53.1; 261/23.2, 36.2
See application file for complete search history.

(56) References Cited

U.S. PATENT DOCUMENTS

| | | | | |
|---|---|---|---|---|
| 1,403,350 | A * | 1/1922 | Short | 123/54.7 |
| 2,525,374 | A * | 10/1950 | Ruzicka | 123/542 |
| 2,957,455 | A * | 10/1960 | Bouvy | 123/54.6 |
| 2,957,460 | A * | 10/1960 | Kolbe | 123/54.7 |
| 2,974,541 | A * | 3/1961 | Dolza | 74/579 R |
| 3,111,120 | A * | 11/1963 | Cornell | 123/572 |
| 3,581,722 | A * | 6/1971 | McKellar | 123/556 |
| 4,142,502 | A * | 3/1979 | Nakano et al. | 123/195 A |
| 4,463,711 | A | 8/1984 | Yoshioka | |
| 4,658,767 | A * | 4/1987 | Fujikawa et al. | 123/41.65 |
| 5,647,337 | A * | 7/1997 | Johnson et al. | 123/572 |
| 5,813,384 | A * | 9/1998 | Lavender et al. | 123/198 E |
| 6,227,179 | B1 | 5/2001 | Eiermann et al. | |
| 6,510,823 | B2 * | 1/2003 | Hirano et al. | 123/54.4 |
| 6,647,944 | B2 | 11/2003 | Kamiya | |
| 6,718,934 | B2 * | 4/2004 | Ohsawa | 123/192.2 |
| 6,722,323 | B2 | 4/2004 | Kawamoto | |
| 6,735,863 | B1 * | 5/2004 | Hayman | 29/888.06 |
| 6,889,635 | B2 * | 5/2005 | Geisheker et al. | 123/41.65 |
| 6,895,919 | B1 * | 5/2005 | Taxon | 123/192.2 |
| 7,284,508 | B2 * | 10/2007 | Dopke et al. | 123/41.56 |
| 7,690,346 | B2 * | 4/2010 | Edamatsu et al. | 123/184.21 |
| 2003/0062018 | A1 | 4/2003 | Okano et al. | |

(Continued)

FOREIGN PATENT DOCUMENTS

DE 19729436 A1 2/1998

(Continued)

*Primary Examiner* — Nathaniel Wiehe
*Assistant Examiner* — Hung Q Nguyen
(74) *Attorney, Agent, or Firm* — Arent Fox LLP

(57) ABSTRACT

A V-type engine includes: first and second banks which are arranged in a V-shape and which respectively have cylinder bores; a crankshaft which is shared by the first and second banks; a crankcase which supports the crankshaft, the first and second banks being connected to the crankcase; and a valley portion which is defined between the first and second banks, an engine auxiliary machine being disposed in the valley portion. The first and second banks are arranged so that a cylinder center line of the first bank and a cylinder center line of the second bank respectively pass through a point which is eccentric from a rotational center of the crankshaft to a side opposite from both the banks. Thus, it is possible to improve an auxiliary machine housing function of the valley portion defined between the first and second banks while maintaining a predetermined opening angle therebetween.

1 Claim, 10 Drawing Sheets

U.S. PATENT DOCUMENTS

| | | | | |
|---|---|---|---|---|
| 2005/0011476 | A1* | 1/2005 | Murata et al. | 123/54.4 |
| 2005/0011695 | A1* | 1/2005 | Murata et al. | 180/297 |
| 2006/0260569 | A1* | 11/2006 | Nelson | 123/54.4 |
| 2008/0164696 | A1* | 7/2008 | Edamatsu et al. | 285/368 |

FOREIGN PATENT DOCUMENTS

| | | | |
|---|---|---|---|
| EP | 0 987 410 | B1 | 3/2003 |
| GB | 2 219 829 | A | 12/1989 |
| JP | 60 053625 | A | 3/1985 |
| JP | 2000-192867 | A | 7/2000 |
| JP | 2000-213365 | A | 8/2000 |
| JP | 2000-213429 | A | 8/2000 |
| JP | 2000 257440 | A | 9/2000 |
| JP | 2002-089360 | A | 3/2002 |
| JP | 2002-256802 | A | 9/2002 |
| JP | 2005-113743 | A | 4/2005 |
| JP | 2005-26867 | A | 8/2005 |
| JP | 2005-207232 | A | 8/2005 |
| TW | 404917 | B | 9/2000 |
| TW | 475028 | B | 2/2002 |
| TW | 482249 | Y | 4/2002 |
| TW | 542871 | B | 7/2003 |

* cited by examiner

V-TYPE ENGINE

CROSS-REFERENCE TO RELATED APPLICATION

This application claims the priority of Japan Application No. 2006-346625, filed Dec. 22, 2006, the entire specification, claims and drawings of which are incorporated herewith by reference.

BACKGROUND OF THE INVENTION

1. Field of the Invention

The present invention relates to an improvement of a V-type engine comprising: first and second banks which are arranged in a V-shape and which respectively have cylinder bores; a crankshaft which is shared by the first and second banks; a crankcase which supports the crankshaft, the first and second banks being connected to the crankcase; and a valley portion which is defined between the first and second banks, an engine auxiliary machine being disposed in the valley portion.

2. Description of the Related Art

Such a V-type engine is already known as disclosed in, for example, Japanese Patent Application Laid-open No. 2000-213429.

This V-type engine is a compact large-displacement engine having a small overall height because of a structure where first and second banks are arranged in a V shape, and an engine auxiliary machine such as a carburetor is disposed in a valley portion defined between the banks.

Generally, in such a V-type engine, other engine auxiliary machines such as an air cleaner and a fuel tank are also disposed above the engine auxiliary machine such as a carburetor disposed in the valley portion. Therefore, in order to suppress the overall height of the engine including these other engine auxiliary machines, it is necessary to improve an auxiliary machine housing function of the valley portion.

SUMMARY OF THE INVENTION

The present invention has an object to provide a compact V-type engine having a small overall height. This V-type engine includes a valley portion which is defined between first and second banks and has an improved auxiliary machine housing function while maintaining a predetermined opening angle therebetween.

To achieve the above object, according to a first aspect of the present invention, there is provided a V-type engine comprising: first and second banks which are arranged in a V-shape and which respectively have cylinder bores; a crankshaft which is shared by the first and second banks; a crankcase which supports the crankshaft, the first and second banks being connected to the crankcase; and a valley portion which is defined between the first and second banks, an engine auxiliary machine being disposed in the valley portion, wherein the first and second banks are arranged so that a cylinder center line of the first bank and a cylinder center line of the second bank respectively pass through a point which is eccentric from a rotational center of the crankshaft to a side opposite from both the banks.

With the first feature of the present invention, the valley portion defined between the first and second banks can be made large while maintaining a desired opening angle between the cylinder center lines of the first and second banks. Therefore, the auxiliary machine of the engine can be housed in the valley portion with a margin, thereby providing a compact V-type engine having a small overall height.

According to a second feature of the present invention, in addition to the first feature, the engine auxiliary machine is a twin carburetor having a pair of first and second intake paths extending in a direction orthogonal to the crankshaft; and the first and second intake paths individually communicate with intake ports of the first and second banks via first and second conduit paths.

With the second feature of the present invention, the intake interference between the first and second banks is avoided and the intake resistance is minimized, thereby improving an output performance of the engine.

According to a third feature of the present invention, in addition to the second feature, the pair of first and second conduit paths are integrally connected to each other by a common flange at their upstream ends so as to constitute an intake manifold; and the common flange is joined to a downstream end of the twin carburetor.

With the third feature of the present invention, the common flange of the intake manifold is joined to the downstream end of the twin carburetor, thereby simplifying the structure of an intake system of the V-type engine to provide an excellent assemblability of the intake system.

The above-mentioned object, other objects, characteristics, and advantages of the present invention will become apparent from preferred embodiments, which will be described in detail below by reference to the attached drawings.

DESCRIPTION OF THE PREFERRED EMBODIMENTS

Figure 1:
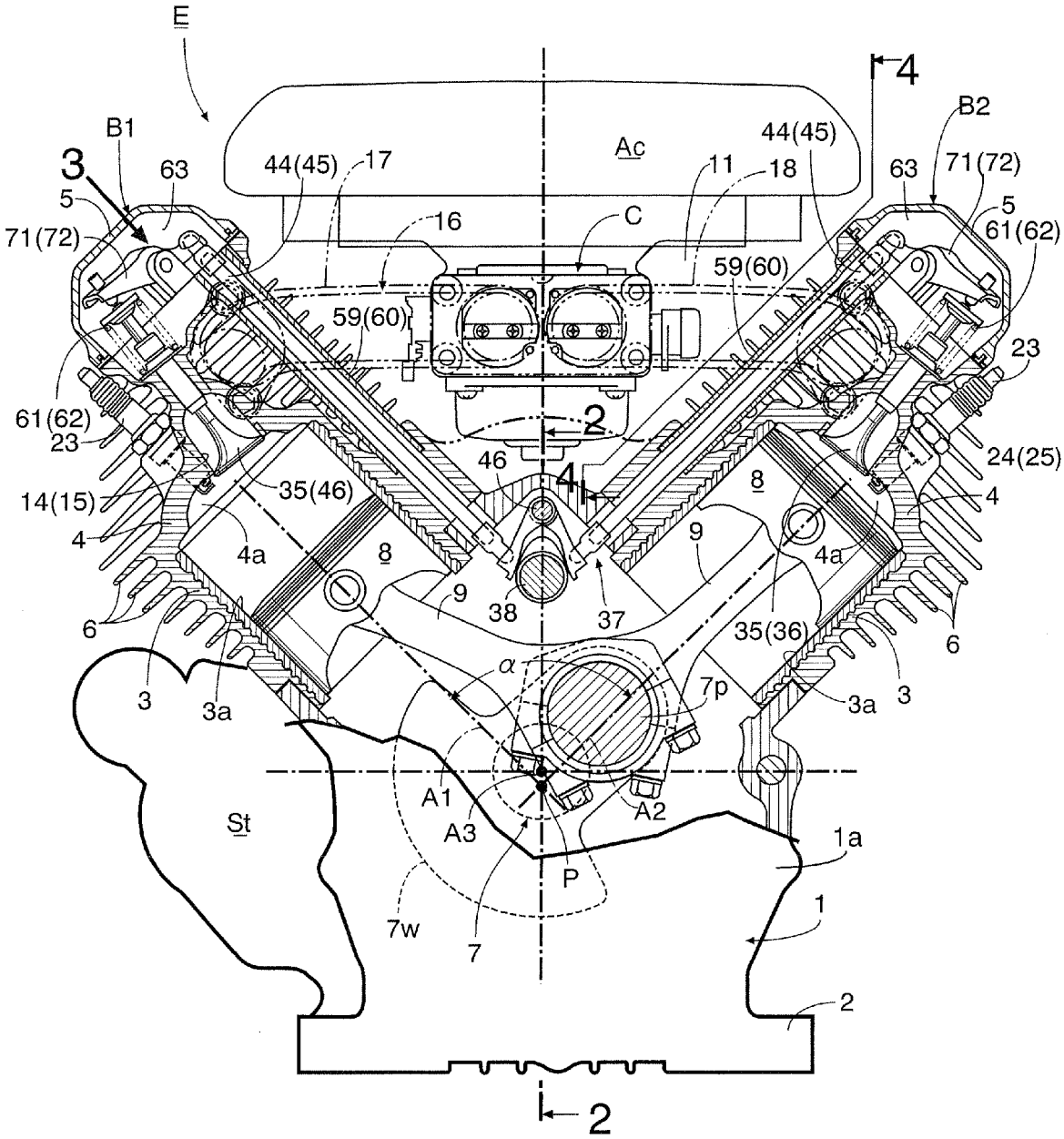
FIG. 1 is a vertical sectional front view of an air-cooling general-purpose V-type engine according to the present invention.
Figure 2:
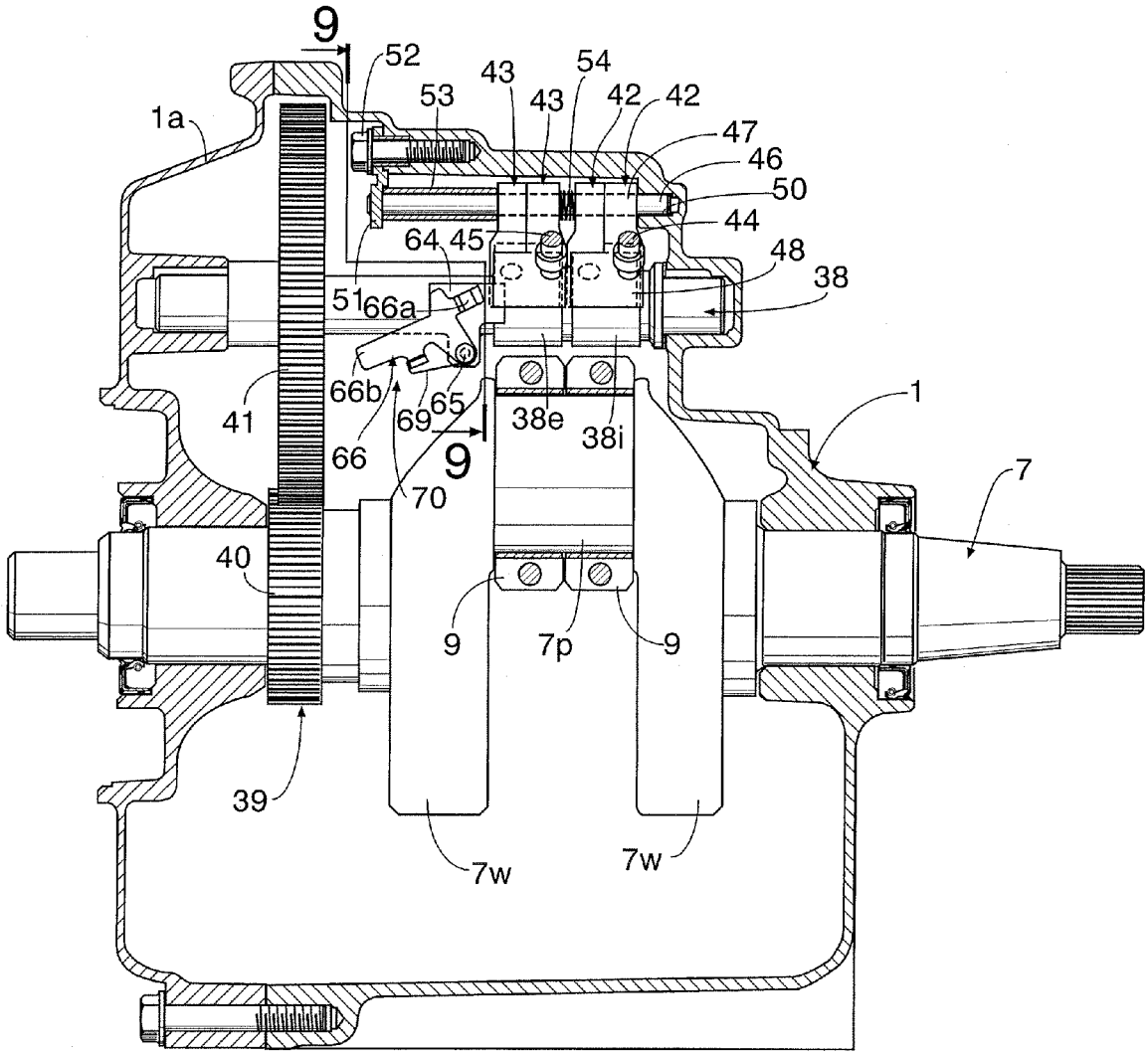
FIG. 2 is a sectional view taken along line 2-2 in FIG. 1.
Figure 3:
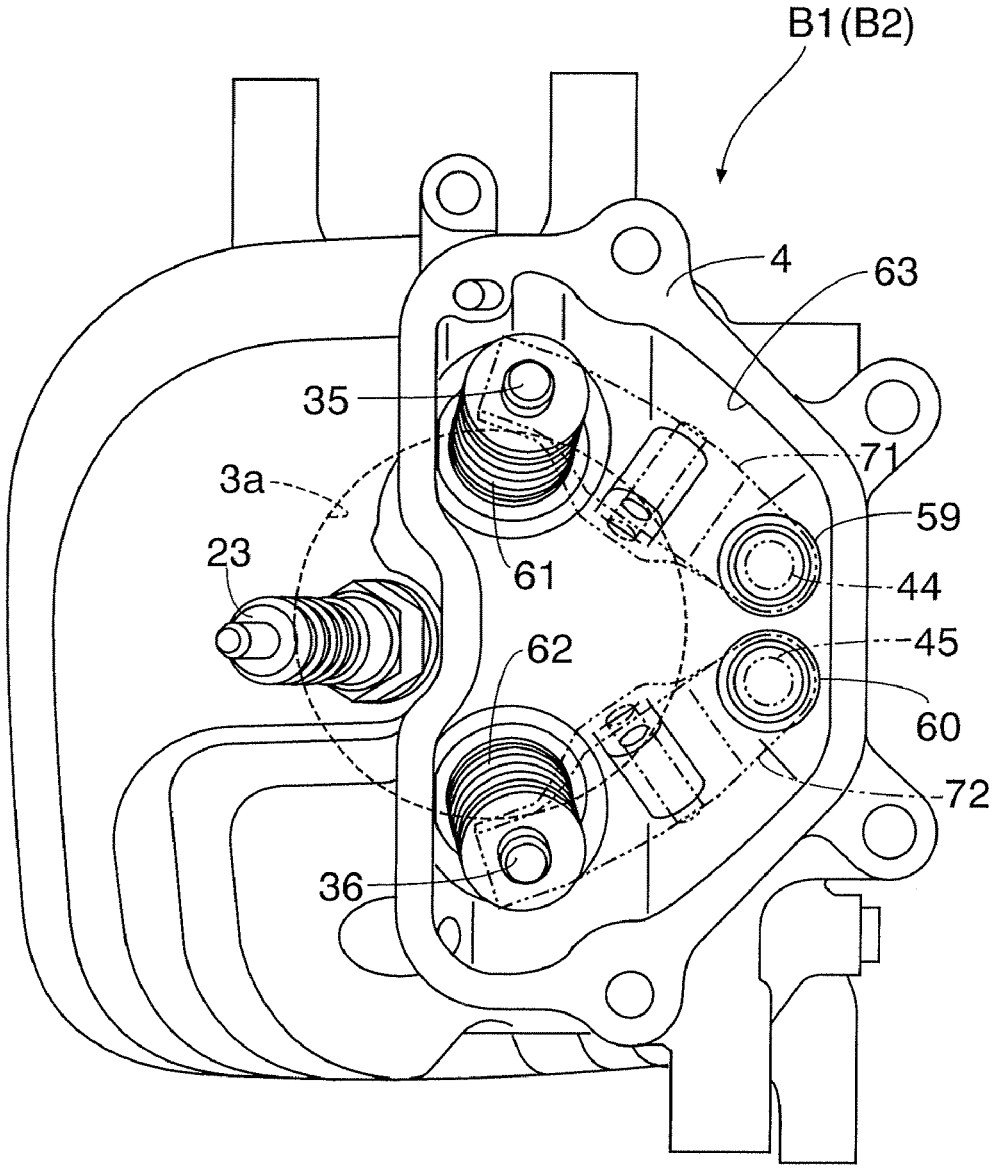
FIG. 3 is a view taken in the direction of arrow 3 in FIG. 1.

First, FIGS. 1 to 3 show an air-cooling general-purpose V-type engine which comprises: a crankcase 1; a first bank B1 and a second bank B2 are arranged in a V shape and connected to an upper portion of the crankcase 1; an installation flange 2 formed in a bottom portion of the crankcase 1; and a starter St provided on one side portion of the crankcase 1 so as to be housed in a space below the first bank B1.

Each of the first bank B1 and the second bank B2 comprises: a cylinder block 3 having a cylinder bore 3*a* and connected to the crankcase 1 by a bolt; a cylinder head 4 which has a valve chamber 4*a* leading to the cylinder bore 3*a* and which is integrally connected to the cylinder block 3; and a head cover 5 connected to an end surface of the cylinder head 4 by a bolt. A plurality of air-cooling fins 6 are integrally projectingly provided on outer surfaces of the cylinder block 3 and the cylinder head 4.

A single crankshaft 7 is supported in longitudinally opposite end walls of the crankcase 1. Pistons 8, 8 are connected to a crank pin 7*p* of the crankshaft 7 via connecting rods 9, 9 so as to be fitted in the cylinder bores 3*a*, 3*a* of the first and second banks B1 and B2. One of the longitudinally end wall 1*a* of the crankcase 1 is detachably attached to a main body of the crankcase 1, while enabling support of one end of the crankshaft 7.

The first and second banks B1 and B2 are disposed so that an opening angle α between the banks B1 and B2, that is, an angle α which is formed by a cylinder center line A1 of the first bank B1 and a cylinder center line A2 of the second bank B2 becomes 90°. Meanwhile, counterweights 7*w* are attached to the crankshaft 7 on a side opposite from the crank pin 7*p* so as to balance inertia forces of the pistons 8 of the banks B1 and B2.

Figure 6:
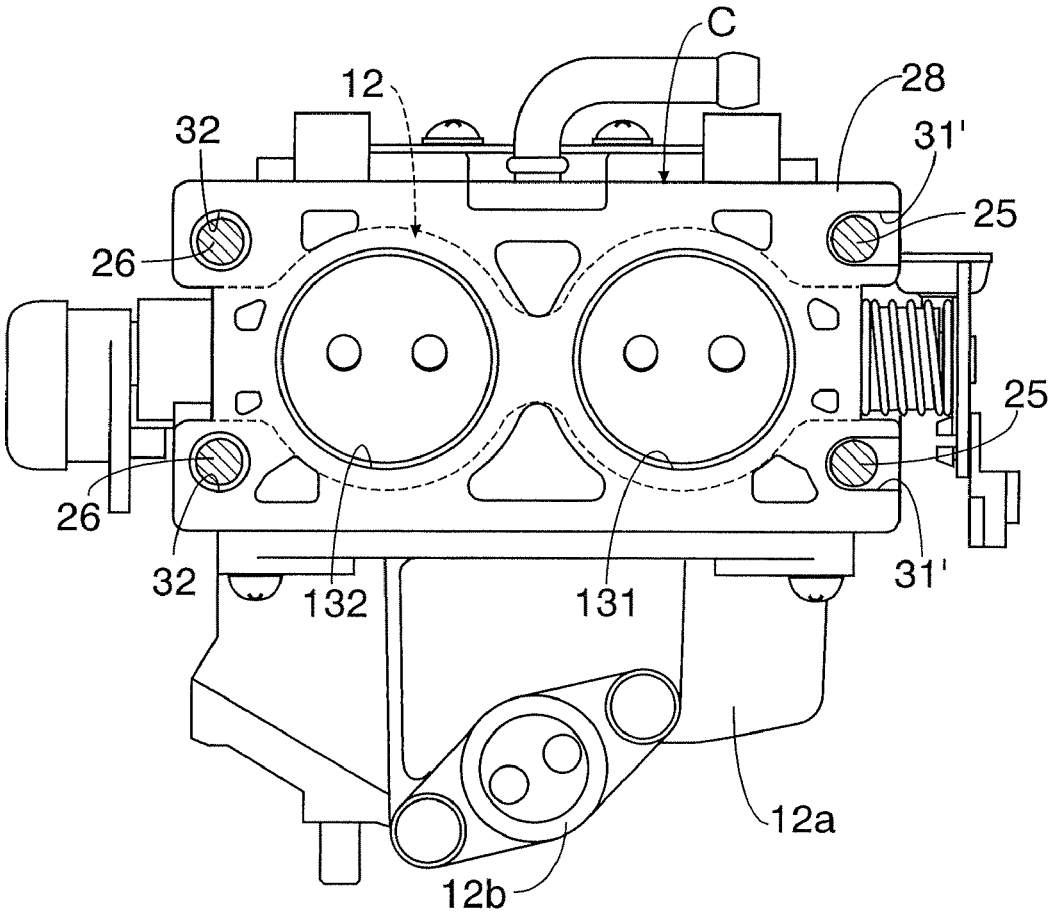
FIG. 6 is a sectional view taken along line 6-6 in FIG. 4.

The first and second banks B1 and B2 are disposed so that the cylinder center line A1 of the first bank B1 and the cylinder center line A2 of the second bank B2 pass through a point P which is eccentric from a rotational center A3 of the crankshaft 7 to the side opposite from both the banks B1 and B2. With this arrangement, a valley portion 11 defined between the first and second banks B1 and B2 can be made large while maintaining the opening angle .alpha. of the banks B1 and B2 at 90°. The valley portion 11 houses an entire carburetor C which is one auxiliary machine of an engine E, and a part of an air cleaner Ac containing a cleaner element 10. As clearly shown in FIG. 6, the carburetor C is of a twin type comprising: a carburetor main body 12; and horizontal (in a direction parallel to the crankshaft 7) first and second intake paths 131 and 132 which are disposed in the carburetor main body 12 in a direction of arrangement of the first and second banks B1 and B2. A float chamber 12*a* and a fuel-cutting electromagnetic valve 12*b* are mounted to a lower portion of the carburetor main body 12.

Figure 4:
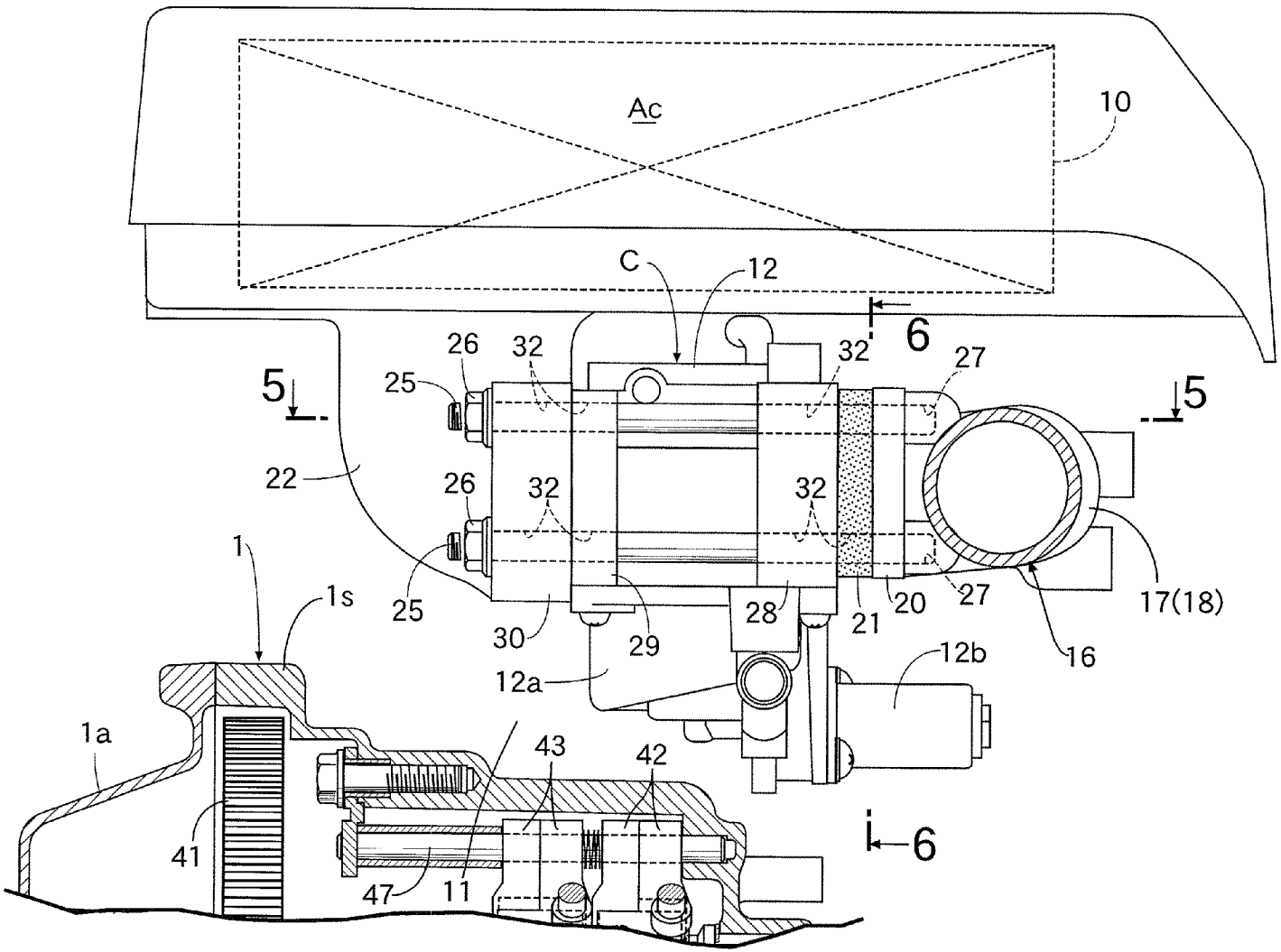
FIG. 4 is a sectional view taken along line 4-4 in FIG. 1.
Figure 5:
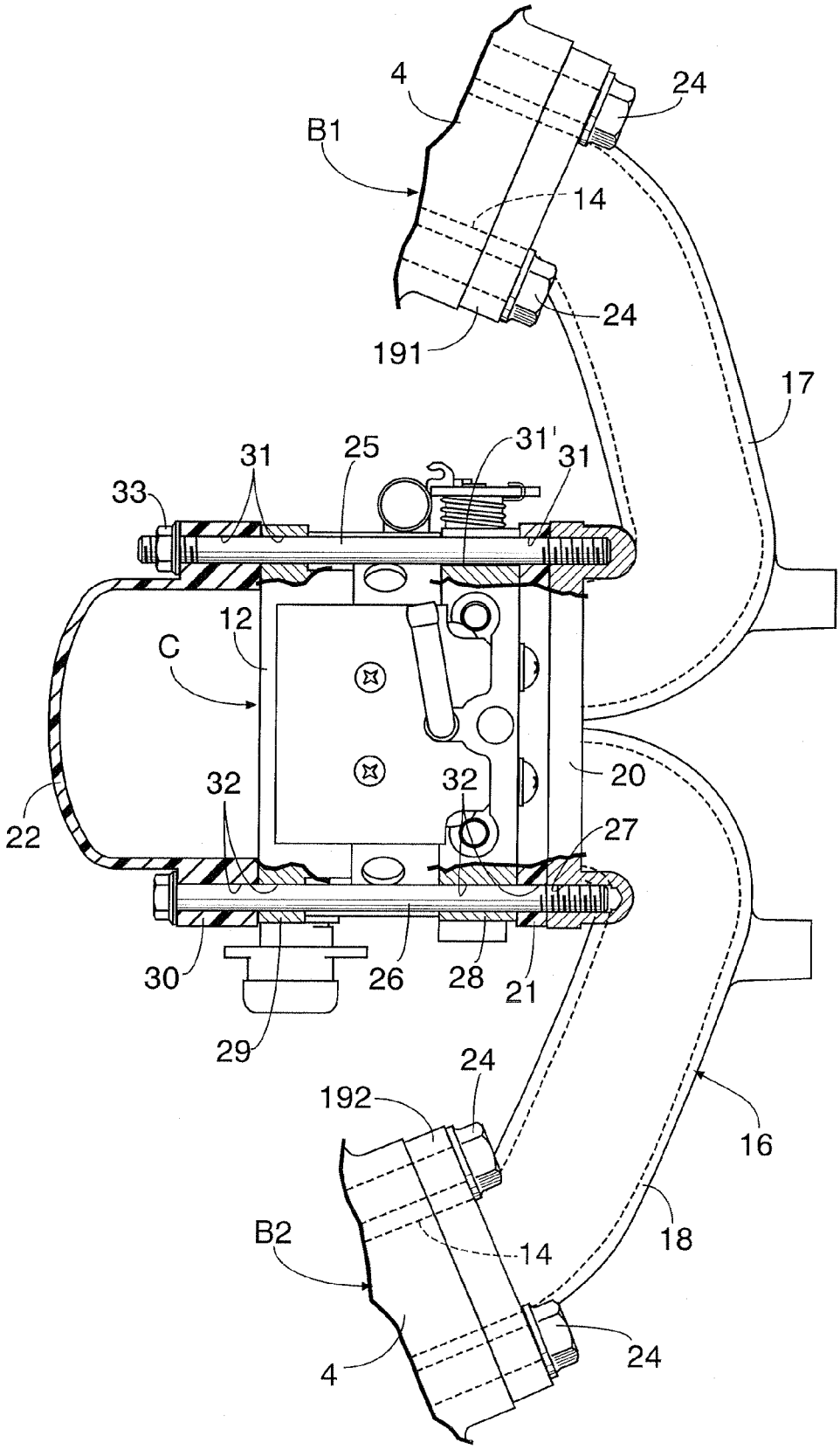
FIG. 5 is a sectional view taken along line 5-5 in FIG. 4.

As shown in FIGS. 1, 4 and 5, each cylinder head 4 of the first and second banks B1 and B2 includes an intake port 14 and an exhaust port 15 which are opened to a valve chamber 4*a*. The first and the second intake paths 131 and 132 are connected to the intake ports 14 and 14 of the first and second banks B1 and B2 via an intake manifold 16.

More specifically, the intake manifold 16 includes first and second conduit paths 17 and 18 which are bent outwards sideways of the valley portion 11 into a U-shape on the horizontal plane, and communicates the intake ports 14 and 14 of the first and second banks B1 and B2 with the first and second intake paths 131 and 132. Flanges 191 and 192 are individually formed at the downstream ends of the first and second conduit paths 17 and 18. A common flange 20 is formed at the upstream ends of the first and second conduit paths 17 and 18 so as to integrally connect them to each other. The individual flanges 191 and 192 are connected to the first and second cylinder heads 4 and 4 by bolts 24 and 24, respectively. A thermal insulating plate 21, first and second mounting flanges 28 and 29 which are formed respectively at the downstream end and the upstream end of the carburetor C, a mounting flange 30 which is formed at an outer periphery of an elbow-shaped air outlet pipe 22 in the air cleaner Ac, are jointly fastened to the common flange 20 by a plurality of bolts.

Next, the jointly fastening structure will be described based on FIGS. 4 to 8.

The above-described jointly fastening structure uses two stud bolts 25 and 25 and two tap bolts 26 and 26. The two stud bolts 25 and 25 are implanted in upper and lower spots in one side portion of the common flange 20 of the intake manifold 16. A pair of upper and lower screw holes 27 and 27 are provided in the other side portion of the common flange 20 so that the two tap bolts 26 and 26 can be screwed thereinto. Also, first bolt holes 31, 31, 31', 31' through which the two stud bolts 25 and 25 pass as well as second bolt holes 32 and 32 through which the two tap bolts 26 and 26 pass are provided in the first and second mounting flanges 28 and 29 of the thermally insulating plate 21 and the carburetor C as well as the mounting flange 30 of the air cleaner Ac. Particularly, each of the first bolt holes 31' and 31' of the first mounting flange 28 of the carburetor C is formed into a notched shape opened outwards sideways of the flange 28.

Gaskets are interposed in front and rear of the thermally insulating plate 21, if necessary.

As shown in FIGS. 1 and 3, an intake valve 20 and an exhaust valve 21 are provided in each cylinder head 4 so as to open and close the intake port 14 and the exhaust port 15, respectively. A valve-operating device 37 for opening and closing the intake and exhaust valves 20 and 21 is provided in a region extending from the crankcase 1 to the cylinder head 4. An ignition plug 23 is screwed into each cylinder head 4 such that its electrode faces the central portion of the valve chamber 4*a*.

Next, the valve-operating device 37 will be described based on FIGS. 1 to 3 and 9.

The valve-operating device 37 includes: a camshaft 38 which is supported in longitudinally opposite end walls of the crankcase 1 directly above the crankshaft 7 so as to be parallel with the crankshaft 7; and a timing transmission 39 which reduces the rotational speed of the crankshaft 7 by one half and transmits it to the camshaft 38. The timing transmission 39 includes: a driven timing gear 40 which is fixed to the crankshaft 7 at a position adjacent to the inner surface of the attachable/detachable end wall 1*a* of the crankcase 1; and a follower timing gear 41 which is fixed to the camshaft 38 and meshed with the driven timing gear 40.

An intake cam 38*i* and an exhaust cam 38*e* are integrally formed on the camshaft 38. The intake cam 38*i* is connected to intake valves 35 and 35 of the first and second banks B1 and B2, respectively, via a pair of intake cam followers 42 and 42, intake push rods 44 and 44, and intake rocker arms 71 and 71. The exhaust cam 38*e* is connected to exhaust valves 36 and 36 of the first and second banks B1 and B2, respectively, via a pair of exhaust cam followers 43 and 43, exhaust push rods 45 and 45 and exhaust rocker arms 72 and 72.

The respective pairs of intake cam followers 42 and 42 and exhaust cam followers 43 and 43 include: boss portions 47 swingably supported by a single cam follower shaft 46 which is mounted to the crankcase 1 directly above the camshaft 38 so as to be parallel with the camshaft 38; and slipper portions 48 which slide in contact with the corresponding cams 38*i* and 38*e*. In the pair of intake cam followers 42 and 42, their boss portions 47 and 47 are adjacent to each other on the cam follower shaft 46, and their slippers 48 and 48 are opposed to each other with the intake cam 38*i* therebetween. Also in the exhaust cam followers 43 and 43, their boss portions 47 and 47 are adjacent to each other on the cam follower shaft 46, and their slippers 48 and 48 are opposed to face each other with the exhaust cam 38*e* therebetween.

As shown in FIG. 2, one end of the cam follower shaft 46 is supported by a support hole 50 in the crankcase 1, and the other end thereof is supported by a bracket 51 which is fixed to the crankcase 1 by a bolt 52. The cam follower shaft 46 is provided with a distance collar 53 which abuts on the outer end surface of the boss portion 47 of the exhaust cam follower 43, and a coil spring 54 which is interposed between the boss portions 47 and 47 of the intake cam followers 42 and 42 and the exhaust cam followers 43 and 43. With these distance collar 53 and the coil spring 54, the intake cam followers 42 and 42 and the exhaust cam followers 43 and 43 are held at fixed positions on the cam follower shaft 46.

Semispherical engaging recesses 55 are formed on rear surfaces of the intake cam followers 42 and 42 and the exhaust cam followers 43 and 43. The semispherical lower ends of the intake push rods 44 and 44 are engaged with the engaging recesses 55 and 55 of the intake cam followers 42 and 42. The semispherical lower ends of the exhaust push rods 45 and 45 are engaged with the engaging recesses 55 and 55 of the exhaust cam followers 43 and 43.

As shown in FIGS. 1 and 3, in each of the banks B1 and B2, the intake and exhaust push rods 44 and 45 are housed in a pair of guide pipes 59 and 60 which are adjacent to the outer side surface of the cylinder block 3 on the side of the valley portion 11 and provides connection between the bottom wall of the cylinder head 4 and the ceiling wall of the crankcase 1.

Also, in each of the banks B1 and B2, intake and exhaust rocker arms 71 and 72 are swingably supported by the cylinder head 4. Valve springs 61 and 62 are fitted to the intake and exhaust valves 35 and 36 so as to urge them in the valve closing direction. These valve springs 61 and 62 and the intake and exhaust rocker arms 71 and 72 are housed in a valve-operating chamber 63 defined between the cylinder head 4 and the head cover 5.

As shown in FIG. 2, the camshaft 38 has a flat portion 64 which is formed in a region extending from a general surface of the camshaft 38 to a base surface of the exhaust cam 38*e*. A decompressing member 66 is swingably supported on the flat portion 64 via a pivot 65. The decompressing member 66 is made of a steel plate, and comprises: a decompressing arm 66*a* which is located on the base surface side of the exhaust cam 38*e* and has a tip end which projects from the base surface at the time of stopping and starting the engine E; and a centrifugal weight 66*b* which generates a centrifugal force for retreating the decompressing arm 66*a* from the base surface when the engine is rotated at a rotational speed higher than that in idling of the engine E. A return spring 69 for urging the decompressing arm 66*a* in the direction to retreat from the base surface is connected to the decompressing member 66. Therefore, a decompressing device 70 is constituted by these components described above.

Figure 9:
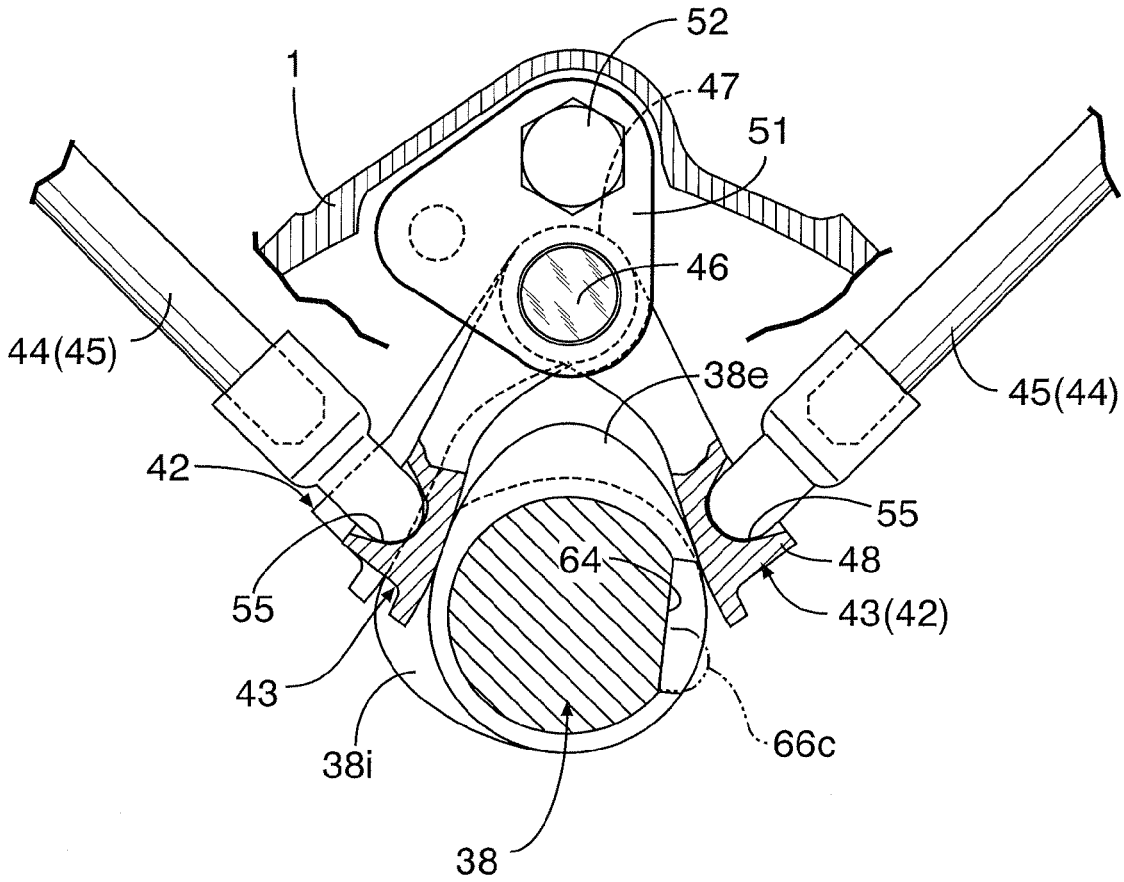
FIG. 9 is an enlarged sectional view taken along line 9-9 in FIG. 2.

Thus, at the time of start of the engine E, the decompressing arm 66*a* occupies the position where its tip end projects from the base surface of the exhaust cam 38*e* (see the chain line in FIG. 9). Therefore, also in the compression stroke, the exhaust cam followers 43 and 43 are very slightly lifted by the decompressing arm 66*a* to slightly open the exhaust valves 36 and 36 of the first and second banks B1 and B2, thereby lowering the compression pressure in the cylinder bores 3*a* and 3*a* to alleviate the starting load. After the engine E is started, when the cam shaft 38 is rotated at a predetermined rotational speed or more, the centrifugal weight 66*b* swings outward in the radial direction against the set load of the return spring 69 due to the centrifugal force acting on the centrifugal weight 66*b*, whereby the decompressing arm 66*a* is retreated from the base surface of the exhaust cam 38*e*.

Next, the operation of the embodiment will be described.

As described above, the first and second banks B1 and B2 are disposed so that the opening angle α between the banks B1 and B2 becomes 90°, and the counterweights 7*w* are attached to the crankshaft 7 on a side opposite from the crank pin 7*p* so as to balance inertia forces of the pistons 8 of the banks B1 and B2. Therefore, as is well known, the inertia force at the top dead center and bottom dead center of the piston 8 of each of the banks B1 and B2 balances the inertia force of the counterweight 7*w*. Thus, the primary inertia force of the engine E can be balanced without providing a special primary balancer mechanism.

Further, the first and second banks B1 and B2 are disposed so that the cylinder center line A1 of the first bank B1 and the cylinder center line A2 of the second bank B2 pass through the point P which is eccentric from the rotational center A3 of the crankshaft 7 to the side opposite from both the banks B1 and B2. Therefore, the valley portion 11 defined between the first and second banks B1 and B2 can be made large while maintaining the opening angle α=90° between the banks B1 and B2. Thus, the valley portion 11 can house the entire carburetor C which is an auxiliary machine of the engine E and a part of the air cleaner Ac with a margin, thereby providing a compact V-type engine E having a small overall height.

In this structure, the carburetor C is of a twin type comprising the horizontal (a direction orthogonal to the crankshaft 7) first and second intake paths 131 and 132 which are disposed in a direction of arrangement of the first and second banks B1 and B2; and the first and second intake paths 131 and 132 individually connected to the intake ports 14 and 14 of the first and second banks B1 and B2 via the pair of conduit paths 17 and 18. Therefore, the intake interference between the banks B1 and B2 is avoided, and the intake resistance is minimized, thereby improving the output performance of the engine E.

In addition, the pair of conduit paths 17 and 18 are provided with the common flange 20 at their upstream sides so that the common flange 20 integrally connects them to constitute the intake manifold 16. Therefore, the common flange 20 is connected to the downstream end of the twin carburetor C, thereby simplifying the structure of the intake system of the V-type engine E to provide an excellent assemblability of the intake system.

Figure 7A:
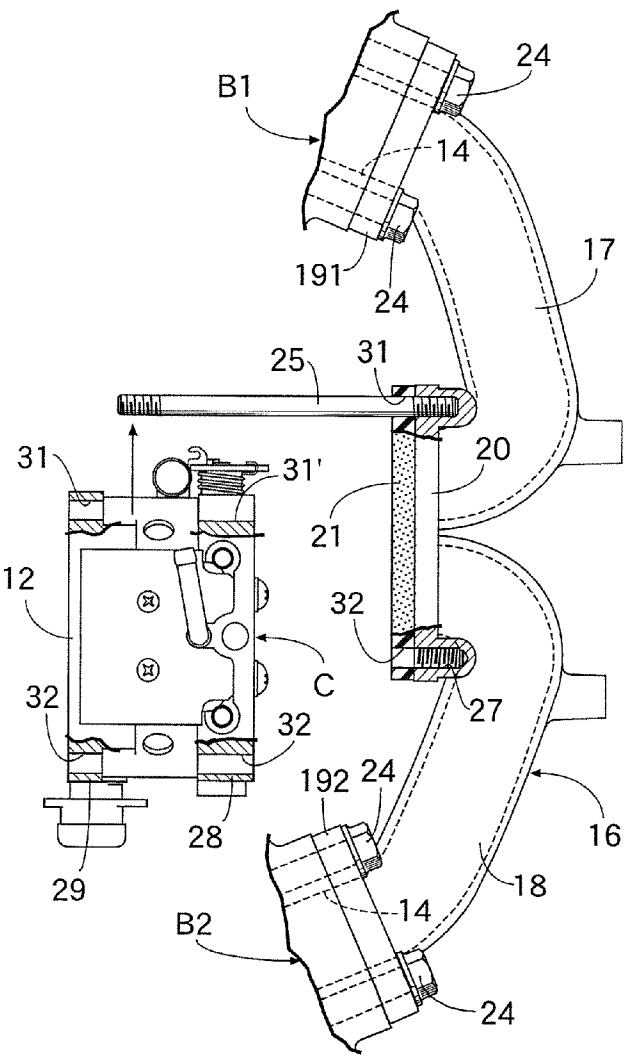
FIG. 7 is a view for explaining a procedure of mounting a carburetor.
Figure 7B:
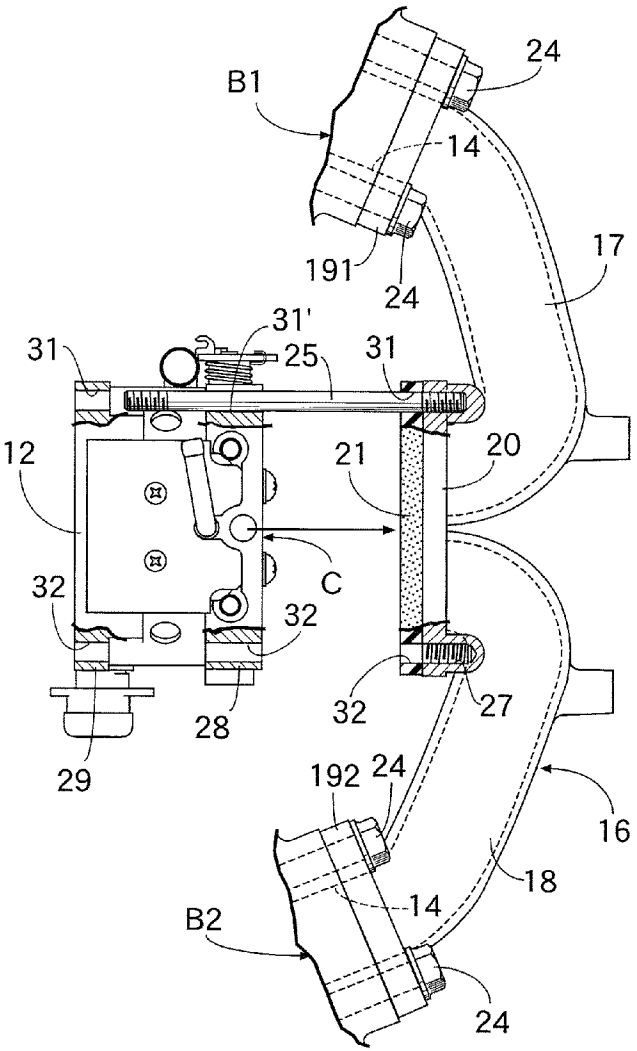

The procedures of mounting the thermally insulating plate 21, the carburetor C and the air cleaner Ac to the common flange 20 of the intake manifold 1 is performed as follows. First, as shown in FIG. 7A, the first bolt holes 31 and 31 of the thermally insulating plate 21 are fitted to the upper and lower stud bolts 25 and 25 vertically provided in the common flange 20. Next, the notched first bolt holes 31' and 31' of the first mounting flange 28 of the carburetor C are engaged with the stud bolts 25 and 25 from their sides (see FIG. 7A). Then, while the entire carburetor C is moved toward the thermally insulating plate 21, the first bolt holes 31 and 31 of the second mounting flange 29 are fitted to the stud bolts 25 and 25 (see FIG. 8). In this procedure, it is possible to set the carburetor C having a relatively large length in the axial direction at a predetermined fitting position with respect to the stud bolts 25 and 25 with a moving amount smaller than the length in the axial direction of the carburetor C, thereby quickly performing the setting of the carburetor C. In addition, even if a space large enough to receive the entire carburetor C does not exist outward of the outer ends of the stud bolts 25 and 25, the carburetor C can be temporarily fixed to the fixed position. In the first embodiment, as shown in FIG. 4, a bulged portion is of the crankcase 1 exists outward of the outer ends of the stud bolts 25 and 25 due to the existence of the large-diameter follower timing gear 41, and the bulged portion is interferes with reception of the float chamber 12*a* and the fuel-cutting electromagnetic valve 12*b* of the carburetor C to a space outward of the outer ends of the stud bolts 25 and 25. Therefore, the temporarily fixing structure of the carburetor C to the fixed position without interference of the bulged portion is remarkably effective.

Figure 8:
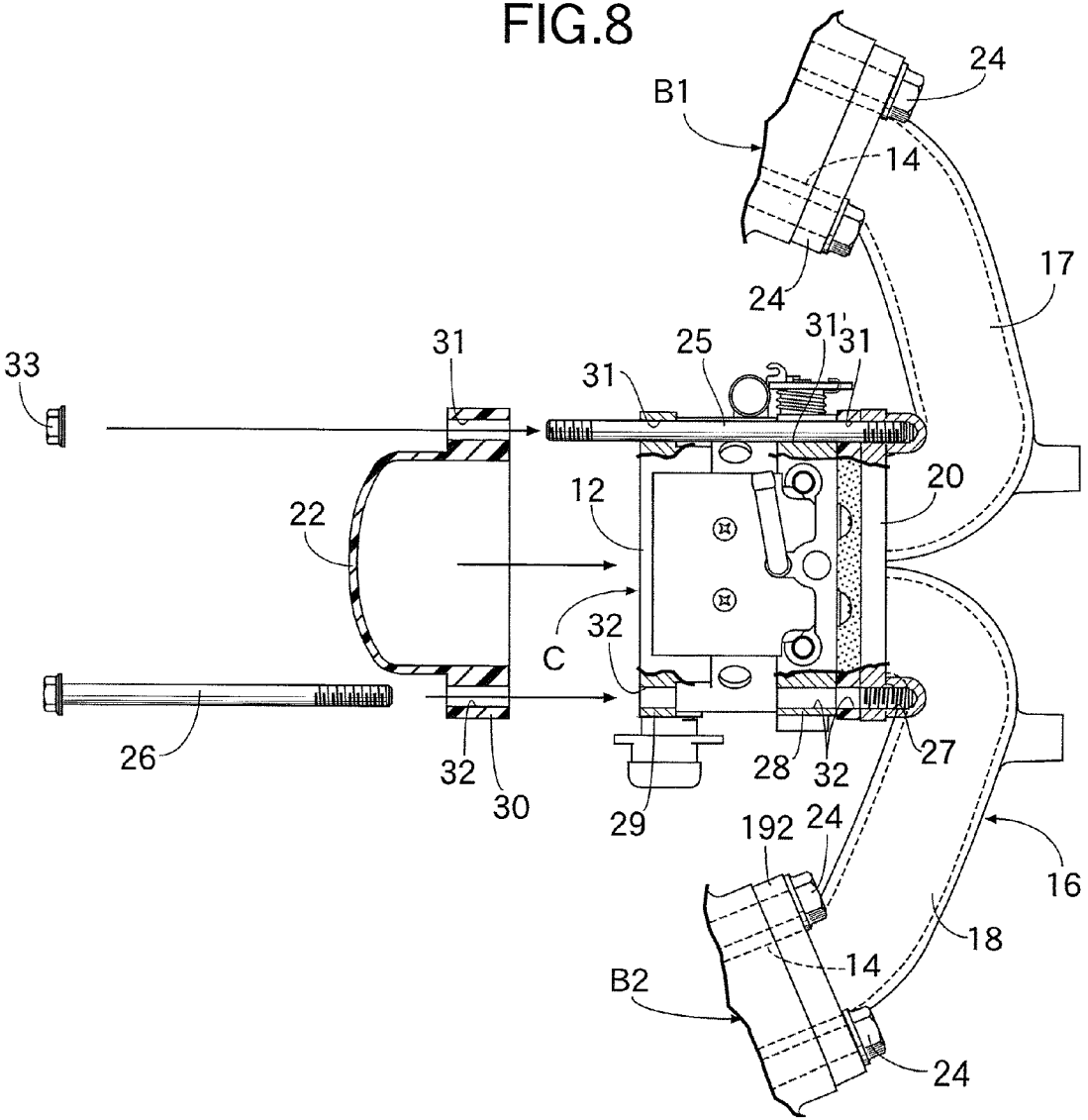
FIG. 8 is a view for explaining a procedure of mounting an air cleaner.

Next, as shown in FIG. 8, the first bolt holes 31 and 31 of the mounting flange 30 of the air cleaner Ac are fitted to the stud bolts 25 and 25; nuts 33 and 33 are finally screwed and fastened to the outer ends of the stud bolts 25 and 25; and the tap bolts 26 and 26 are inserted through all the second bolt holes 32 and 32 to be screwed and fastened into the screw holes 27 and 27 of the common flange 20. In the process of insertion of the tap bolt 26 into the second bolt hole 32, the tap bolt 26 needs to be moved over a distance equal to or larger than the entire length of the carburetor C. However, because the tap bolt 26 is thin, the moving space of the tap bolt 26 can be easily secured in general.

In the above-described structure, the two first bolt holes 31 and 31 of each of the thermally insulating plate 21, the carburetor C and the air cleaner Ac are fitted to the stud bolts 25 and 25, thereby providing a reliable temporary fixed state wherein the rotation of the thermally insulating plate 21, the carburetor C and the air cleaner Ac around the stud bolts 25 and 25 is inhibited. Therefore, the subsequent operation of inserting the tap bolts 26 and 26 into the respective second bolt holes 32 and 32, and operation of screwing the tap bolts 26 and 26 into the screw holes 27 and 27 are facilitated.

Further, by use of the tap bolts 26 and 26 in combination, the carburetor C can be properly fixed in the fixed position without being influenced by the existence of the notched first bolt holes 31' and 31'. Furthermore, the first and second mounting flanges 28 and 29 which are formed at the downstream and upstream ends of the carburetor C are fastened to the common flange 20 by the stud bolts 25 and 25 and the tap bolts 26 and 26, thereby enhancing the mounting strength of the carburetor C.

To dismount the carburetor C and the air cleaner Ac from the common flange 20, the above-described operation procedure is conversely carried out.

In the valve-operating device 37, a pair of intake cam followers 42 and 42 and a pair of exhaust cam followers 43 and 43 include: boss portions 47 swingably supported by the single cam follower shaft 46 which is mounted to the crankcase 1 directly above the camshaft 38 so as to be parallel with the camshaft 38; and slipper portions 48 which slide in contact with the corresponding cams 38*i* and 38*e*. In the pair of intake cam followers 42 and 42, their boss portions 47 and 47 are adjacent to each other on the cam follower shaft 46, and the slippers 48 and 48 are opposed to each other with the exhaust cam 38*e* therebetween. Also in the exhaust cam followers 43 and 43, their boss portions 47 and 47 are adjacent to each other on the cam follower shaft 46, and the slippers 48 and 48 are opposed to each other with the exhaust cam 38*e* therebetween. Therefore, the intake and exhaust cams 38*i* and 38*e* and the pair of intake cam followers 42 and 42 and the pair of exhaust cam followers 43 and 43 can be concentratedly compactly disposed, thereby contributing to reduction in the size of the engine E.

The decompressing device 70 comprising the steel decompressing member 66 mounted to one side surface of the camshaft 38 via the pivot 65 is compact with a simple structure, thereby contributing to reduction in the size of the engine E.

Figure 10:
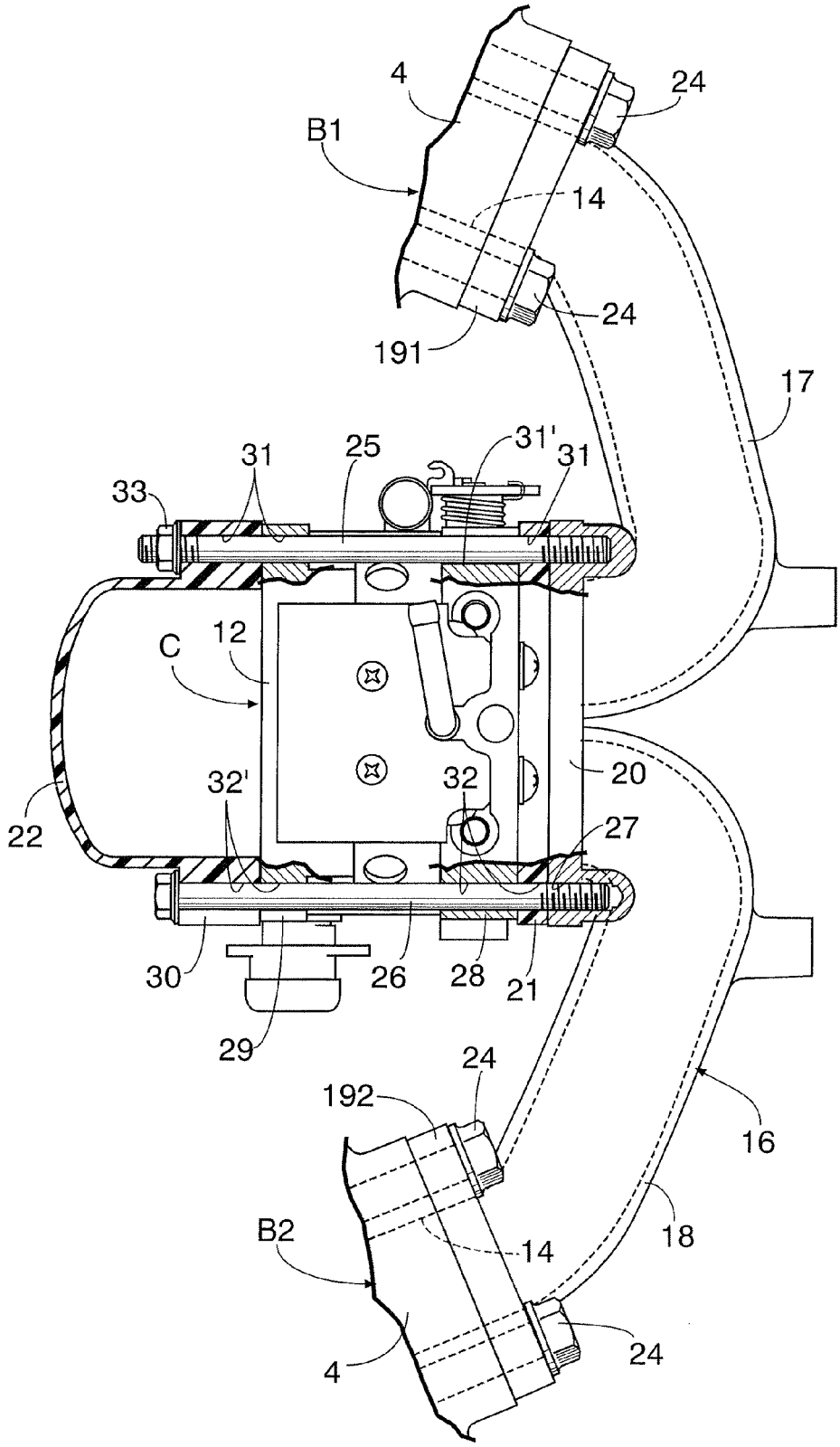
FIG. 10 is a view corresponding to FIG. 5 and showing a second embodiment of the present invention.

Next, a second embodiment of the present invention shown in FIG. 10 will be described.

The second embodiment has the same structure as that of the firsts embodiment except that second bolt holes 32', through which the tap bolt 26 passes, of the mounting flange 29 of the carburetor C and the mounting flange 30 of the air cleaner Ac are each formed into a notched shape as in the case of the first bolt holes 31' of the first embodiment. In FIG. 10, the parts corresponding to those of the first embodiment are denoted by the same reference numerals and symbols, and an overlapping description will be omitted.

The procedure of temporarily fixing the carburetor C in the second embodiment is the same as that in the first embodiment. However, in the second embodiment, at the time of subsequent attaching of the tap bolt 26, the tap bolt 26 is inserted into the notched second bolt hole 32' from its side, thereby reducing the moving amount of the tap bolt 26 in the axial direction to facilitate the attachment of the tap bolt 26 in the narrow space.

The embodiments of the present invention have been described above, but various changes in design may be made without departing from the subject matter of the present invention.

What is claimed is:

1. A V-type engine comprising:

first and second banks which are arranged in a V-shape and which respectively have cylinder bores;

a crankshaft which is shared by the first and second banks;

a crankcase which supports the crankshaft horizontally, the first and second banks being connected to the crankcase;

an installation flange formed at bottom portion of the crankcase; and a valley portion which is defined between the first and second banks, a carburetor being disposed in the valley portion, wherein the first and second banks are arranged so that a cylinder center line of the first bank and a cylinder center line of the second bank respectively pass through a point which is eccentric from a rotational center of the crankshaft to a side opposite from both the banks and define an open angle of 90° between the cylinder center lines of the first and second banks so as to expand the valley portion, wherein an intake valve driving push rod and an exhaust valve driving push rod of each of the first and second banks are disposed inside side walls on the expanded-valley-portion-side of the first and second banks, wherein an intake port is opened in one end face, outside the valley portion of each of the first and second banks, wherein the carburetor is a horizontally arranged twin carburetor having first and second intake paths which are arranged in a direction of arrangement of the first and second banks and extend in a horizontal direction, the carburetor is entirely housed in the expanded valley portion and is connected to the intake ports of the first and second banks via an intake manifold, and wherein the intake manifold comprises first and second conduit paths which are bent outwardly in a sideways direction of the expanded valley portion into a U-shape on a horizontal plane in order to communicate the intake ports of the first and second banks with the first and second intake paths, respectively, and a common flange integrally connecting upstream ends of the first and second conduit paths, the common flange being joined to a downstream end of the twin carburetor, and a part of an air cleaner is housed in the valley portion, the air cleaner being arranged above the horizontally arranged twin carburetor, an elbow-shaped air outlet pipe protruding from a bottom surface of the air cleaner and connected to an upstream end of the twin carburetor.

* * * * *